US011466681B1

(12) United States Patent
Zahran et al.

(10) Patent No.: US 11,466,681 B1
(45) Date of Patent: Oct. 11, 2022

(54) ANTI-GAS LOCKING PUMPS AND RELATED METHODS IN OIL AND GAS APPLICATIONS

(71) Applicant: Saudi Arabian Oil Company, Dhahran (SA)

(72) Inventors: Amr Mohamed Zahran, Al Khobar (SA); Syed Muhammad Bin Syed Taha, Dhahran (SA); Bagus Wahyu Setiadi, Dhahran (SA); Mohammed Ahmed Alsayed, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/332,080

(22) Filed: May 27, 2021

(51) Int. Cl.

| | |
|---|---|
| ***F04B 53/10*** | (2006.01) |
| ***E21B 43/12*** | (2006.01) |
| ***F04B 47/02*** | (2006.01) |
| ***F04B 53/12*** | (2006.01) |

(52) U.S. Cl.
CPC ..... *F04B 53/1082* (2013.01); *E21B 43/126* (2013.01); *F04B 47/026* (2013.01); *F04B 53/1002* (2013.01); *F04B 53/126* (2013.01)

(58) Field of Classification Search
CPC ..... E21B 43/126; F04B 47/00–04; F04B 47/026; F04B 47/12–145; F04B 53/1002; F04B 53/1082; F04B 53/125–128; F16K 31/06; F16K 31/0662–0665; F16K 31/08–086
USPC ..... 166/62, 68–68.5, 105–112
See application file for complete search history.

(56) References Cited

U.S. PATENT DOCUMENTS 2,192,945 A * 3/1940 Toney ..... E21B 34/16 166/205
2,764,940 A * 10/1956 Long ..... F04B 47/00 417/313
3,055,306 A * 9/1962 Tausch ..... F16K 31/08 251/65
3,476,355 A * 11/1969 Sherwood ..... F16K 31/088 251/65
3,483,827 A * 12/1969 Hooper ..... F04B 53/1002 166/105.5
3,485,441 A * 12/1969 Eaton, Jr. ..... F04B 39/1013 137/512.1
3,510,234 A * 5/1970 Wolf ..... F04B 47/026 417/450

(Continued)

OTHER PUBLICATIONS

Harbison Fisher, "Variable Slippage Pump," 2001, retrieved on Mar. 15, 2021, retrieved from URL <http://apergycdn.5thring.co.uk/HF_Variable_Slippage_Pump.pdf>, 8 pages.

*Primary Examiner* — Alexander B Comley
(74) *Attorney, Agent, or Firm* — Fish & Richardson P.C.

(57) ABSTRACT

A downhole pump includes a housing, a plunger that is disposed within the housing, and a rod that is secured to the plunger. The housing includes a magnet that is disposed at an uphole end of the housing. The plunger includes a traveling valve that is disposed at a downhole end of the plunger. The rod includes a conducting shaft that is attached to an uphole end of the plunger. The conducting shaft is configured to extend a magnetic field generated by the magnet when the conducting shaft is positioned adjacent the magnet to magnetically force the traveling valve into an open state.

20 Claims, 4 Drawing Sheets

(56) References Cited

U.S. PATENT DOCUMENTS 3,578,886 A * 5/1971 Nino ..... F04B 47/02 417/435
3,773,439 A * 11/1973 Sheridan ..... H02K 49/10 417/415
3,941,516 A * 3/1976 Soberg ..... F04B 5/02 417/259
3,973,630 A * 8/1976 Wheeler ..... E21B 43/121 166/105.3
4,173,451 A * 11/1979 Moore, Jr. ..... F04B 19/022 417/457
4,481,389 A * 11/1984 Johnson ..... H01H 36/0073 335/229
4,565,246 A * 1/1986 Frazier ..... F04B 47/02 166/305.1
4,694,860 A * 9/1987 Eidsmore ..... F16K 31/086 251/76
4,770,389 A * 9/1988 Bodine ..... E21B 34/066 251/129.1
4,808,089 A * 2/1989 Buchholtz ..... F04B 53/1082 417/570
4,848,454 A * 7/1989 Spears ..... F04B 47/12 166/108
4,867,242 A * 9/1989 Hart ..... F04B 47/02 417/443
5,004,004 A * 4/1991 Cummings ..... F16K 24/042 137/413
5,039,061 A * 8/1991 Heard ..... F16K 31/086 137/553
5,139,398 A * 8/1992 Downing ..... F04B 53/1037 417/511
5,141,404 A * 8/1992 Newcomer ..... F04F 1/08 417/133
5,141,411 A * 8/1992 Klaeger ..... F04B 47/02 417/450
5,249,936 A * 10/1993 McConnell ..... F16K 15/04 417/552
5,320,136 A * 6/1994 Morris ..... F16K 31/084 137/516.29
5,472,323 A * 12/1995 Hirabayashi ..... F04B 53/126 310/35
5,655,604 A * 8/1997 Newton ..... F04B 53/005 417/444
6,032,734 A * 3/2000 Telfer ..... E21B 43/10 166/321
6,135,203 A * 10/2000 McAnally ..... F04B 53/1002 166/105.4
6,347,668 B1 * 2/2002 McNeill ..... E21B 21/10 166/332.7
6,648,012 B2 * 11/2003 Linthorst ..... F16K 15/026 251/65
6,988,556 B2 * 1/2006 Vick, Jr. ..... E21B 34/101 166/66.5
7,171,981 B2 * 2/2007 Shade ..... F16K 15/04 251/367
8,297,367 B2 * 10/2012 Chen ..... E21B 23/00 166/66.5
8,414,776 B2 * 4/2013 Hale ..... H01F 7/0294 204/557
9,915,256 B2 3/2018 Bebak et al.
10,174,752 B2 * 1/2019 Downing ..... E21B 34/12
10,364,658 B2 7/2019 Michel
2005/0053503 A1 * 3/2005 Gallant ..... F04B 53/102 417/510
2006/0278198 A1 * 12/2006 Savage ..... F04B 1/0452 123/506
2007/0246211 A1 * 10/2007 Schneider ..... E21B 43/121 166/105
2007/0289734 A1 * 12/2007 McDonald ..... E21B 34/06 166/66.5
2008/0011487 A1 * 1/2008 Bertane ..... F16K 15/042 166/105
2008/0122299 A1 * 5/2008 Cristoforo ..... H02K 7/075 310/23
2009/0251256 A1 * 10/2009 Fullerton ..... H01F 7/0284 335/296
2011/0073319 A1 * 3/2011 Wilson ..... E21B 43/127 166/372
2011/0253382 A1 * 10/2011 Nadkrynechny ..... E21B 43/121 166/372
2015/0024377 A1 * 1/2015 Edwards ..... G01N 33/56911 435/5
2015/0233370 A1 * 8/2015 Bebak ..... F04B 47/02 417/456
2015/0322754 A1 * 11/2015 Simmons ..... E21B 43/121 166/372
2015/0323088 A1 * 11/2015 Zuercher ..... F16K 31/003 137/528
2017/0096884 A1 * 4/2017 Michel ..... F04B 53/125
2018/0086619 A1 * 3/2018 Newton ..... F16K 31/084
2018/0094743 A1 * 4/2018 Hubner ..... B67C 11/04
2020/0386087 A1 * 12/2020 Ferreira Gaglioti .... E21B 43/38
2021/0285557 A1 * 9/2021 Maerz ..... F16K 15/048

* cited by examiner

ANTI-GAS LOCKING PUMPS AND RELATED METHODS IN OIL AND GAS APPLICATIONS

TECHNICAL FIELD

This disclosure relates to downhole pumps designed to avoid a gas locking condition and related methods of operating such downhole pumps.

BACKGROUND

A sucker rod pump is commonly-used type of artificial lift system for oil and gas wells. However, the performance of a sucker rod pump can be negatively affected by the presence of free gas and limited capabilities for handling such free gas. The target fluid to be lifted from a well by a sucker rod pump is liquid. However, if free gas is present with the produced liquid, then the lifting efficiency of the sucker rod pump can be severely reduced. Some solutions exist for handling free gas in sucker rod pump, but these solutions are expensive and may reduce a volumetric pumping efficiency of the sucker rod pump.

SUMMARY

This disclosure relates to downhole pumps that are designed to artificially lift well fluid in a manner that avoids development of a gas locking condition at the downhole pumps without sacrificing volumetric pumping efficiency. An example downhole pump includes a magnet for ensuring that a traveling valve carried on a plunger of the downhole pump is forced to open at the end of an upstroke to vent free gas trapped below the plunger. Escape of the free gas from the downhole pump prevents a gas locking condition during a subsequent downstroke of the downhole pump.

In one aspect, a downhole pump includes a housing, a plunger that is disposed within the housing, and a rod that is secured to the plunger. The housing includes a magnet that is disposed at an uphole end of the housing. The plunger includes a traveling valve that is disposed at a downhole end of the plunger. The rod includes a conducting shaft that is attached to an uphole end of the plunger. The conducting shaft is configured to extend a magnetic field generated by the magnet when the conducting shaft is positioned adjacent the magnet to magnetically force the traveling valve into an open state.

Embodiments may provide one or more of the following features.

In some embodiments, the housing includes a standing valve disposed at a downhole end of the housing.

In some embodiments, the standing valve includes a platform that defines an opening and a ball that is sized to seat within the opening to close the standing valve to prevent fluid flow into the housing.

In some embodiments, the magnet is perforated to allow fluid flow therethrough.

In some embodiments, the rod passes through the magnet.

In some embodiments, the rod further includes an isolating shaft that magnetically isolates the conducting shaft from the magnet while the conducting shaft is spaced axially apart from the magnet.

In some embodiments, the plunger includes a connector that couples the plunger to the rod, and the connector is perforated to allow fluid flow therethrough.

In some embodiments, the traveling valve includes a platform that defines an opening and a ball that is sized to seat within the opening to close the traveling valve to prevent fluid flow into the plunger.

In some embodiments, the ball is magnetic.

In some embodiments, the traveling valve further includes a stopper that is spaced apart from the platform for limiting an axial movement of the ball.

In another aspect, a method of operating a downhole pump includes lifting a plunger of the downhole pump through a housing of the downhole pump with a rod of the downhole pump that supports the plunger, locating a conducting shaft of the rod adjacent a magnet of the housing disposed at an uphole end of the housing, extending a magnetic field generated by the magnet with the conducting shaft to reach a traveling valve of the plunger disposed at a downhole end of the plunger, and magnetically forcing the traveling valve into an open state with the magnetic field.

Embodiments may provide one or more of the following features.

In some embodiments, the method further includes flowing gas from a fluid reservoir of the housing upward and into the plunger through the traveling valve in the open state.

In some embodiments, the method further includes flowing the gas upward and out of the plunger into the housing through openings in the plunger and flowing the gas upward and out of the housing through openings in the magnet to release the gas from the downhole pump.

In some embodiments, the method further includes flowing liquid from a fluid receptacle of the plunger downward and into the fluid reservoir of the housing through the traveling valve in the open state.

In some embodiments, the method further includes moving the plunger downward through the housing with the traveling valve in the open state.

In some embodiments, the method further includes magnetically isolating the conducting shaft of the rod with an isolating shaft of the rod.

In some embodiments, the method further includes preventing fluid from flowing into the housing at a standing valve disposed at a downhole end of the housing.

In some embodiments, the method further includes lifting a column of fluid disposed above the plunger through the housing to the uphole end of the housing and flowing the fluid out of the housing.

In some embodiments, the method further includes flowing fluid into the housing through a standing valve in an open state at a downhole end of the housing.

In some embodiments, the traveling valve includes a platform that defines an opening and a magnetic ball that is sized to seat within the opening to close the traveling valve to prevent fluid flow into the plunger.

The details of one or more embodiments are set forth in the accompanying drawings and description. Other features, aspects, and advantages of the embodiments will become apparent from the description, drawings, and claims.

DETAILED DESCRIPTION

Figure 1:
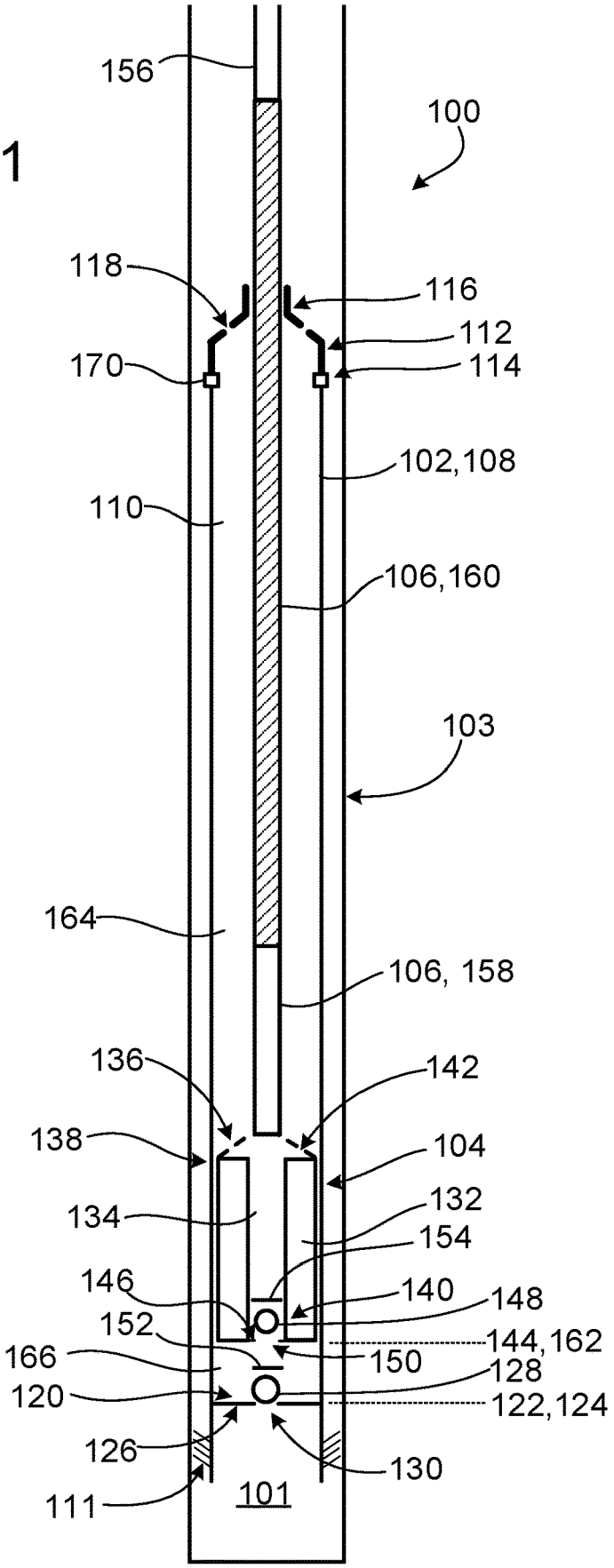
FIG. 1 is a side cross-sectional view of a downhole pump.

FIG. 1 illustrates an example downhole pump 100 that is designed to artificially lift well fluid 101 in a manner that avoids development of a gas locking condition at the downhole pump 100 without sacrificing volumetric pumping efficiency. In some embodiments, the downhole pump 100 may be provided as a modified sucker rod pump that may be disposed within a tubing 103 located within a casing at a well of a rock formation. The downhole pump 100 includes a housing 102 for receiving the well fluid 101, which can include incompressible liquid 107 (for example, a mixture of oil and water) and compressible gas 109. The downhole pump 100 further includes a plunger 104 for lifting well fluid 101 out of the housing 102 and a rod 106 that carries the plunger 104.

The housing 102 includes a cylindrical wall 108 (for example, a barrel) that defines a fluid reservoir 110 for receiving well fluid 101 from the tubing 103. The housing 102 also includes a magnetic guide 112 that is located at an uphole end 114 of the housing 102. The magnetic guide 112 is formed as a shoulder with a tapered portion 116 (for example, having a generally frustoconical shape) that is perforated with openings 118 to allow well fluid 101 to exit the housing 102 at the surface, as will be discussed in more detail below. The magnetic guide 112 and the housing 102 are separated by an isolator 170 (for example, made of ceramic or plastic) that does not transmit magnetic force.

The housing 102 further includes a standing valve 120 (for example, a ball valve) located at a fixed axial position 122 that coincides with a downhole end 124 of the housing 102. The standing valve 120 is openable to allow well fluid 101 to enter the downhole pump 100 from the tubing 103 and closeable to seal the downhole pump 100 to prevent well fluid 101 from falling back to the tubing 103. The standing valve 120 includes a platform 126, a ball 128 that is sized to seat within an opening 130 of the platform 126 to close the standing valve 120, and a stopper 152 (for example, a plate or another component) that is located at a fixed axial position with respect to the wall 108 of the housing 102 to limit an upward movement of the ball 128 within the fluid reservoir 110. The platform 126 and the stopper 152 may be provided by a cage (not shown) that is secured to the housing 102. The wall 108 and the components of the standing valve 120 are typically made of one or more non-conducting materials. In some embodiments, the magnetic guide 112 may be made of or one or more ferromagnetic materials, such as iron, steel, nickel, and cobalt.

Still referring to FIG. 1, the plunger 104 includes a cylindrical wall 132 (for example, a piston cylinder) that defines a fluid receptacle 134 for receiving well fluid 101 from the fluid reservoir 110 of the housing 102. The plunger 104 also includes a connector 136 that is located at an uphole end 138 of the plunger 104. The connector 136 is formed as a tapered structure (for example, having a generally frustoconical shape) that is perforated with openings 142 to allow well fluid 101 disposed within the fluid receptacle 134 to exit the plunger 104, as will be discussed in more detail below.

The plunger 104 further includes a traveling valve 140 (for example, a ball valve) located at a downhole end 144 of the plunger 104. Thus, the traveling valve 140 rides on the plunger 104. The traveling valve 140 is openable to allow well fluid 101 to enter the fluid receptacle 134 of the plunger 104 and closeable to seal the plunger 104 to prevent well fluid 101 from entering the plunger 104 at the downhole end 144. The traveling valve 140 includes a platform 146 and a magnetic ball 148 that is sized to seat within an opening 150 of the platform 146 to close the traveling valve 140, and a stopper 154 (for example, a plate or another component) that is located at a fixed axial position with respect to the wall 132 of the plunger 104 to limit an upward movement of the magnetic ball 148 within the fluid receptacle 134. The platform 146 and the stopper 154 may be provided by a cage (not shown) that is secured to the wall 132.

In some embodiments, the magnetic ball 148 is made of a diamagnetic material that produces magnetization opposing a magnetic field generated by the magnetic guide 112. In other embodiments, the magnetic ball 148 is made of a magnetic material that has a polarization that is different from that of the magnetic guide 112. The stopper 154 is coated with a non-conducting material that can extend a magnetic field generated by the magnetic guide 112 when the plunger 104 is sufficiently close to the magnetic guide 112 to attract the magnetic ball 148 and accordingly pull the magnetic ball 148 upward from the opening 150 of the platform 146. For example, upon contact between the conducting shaft 158 and the magnetic guide 112, the conducting shaft 158 becomes magnetized, and due to different polarizations between the magnetic ball 148 and the magnetic guide 112, the magnetic ball 148 will be pulled from the opening 150.

The wall 132, connector 136, and platform 146 of the plunger 104 are typically made of one or more conducting materials, such as steel. The magnetic ball 148 is typically made of a permanent magnet or a magnetized metal that has different polarity from that of the magnetic guide 112 so that when the entire cage is magnetized, the magnetic ball 148 will be forced from the platform 146.

Figure 4:
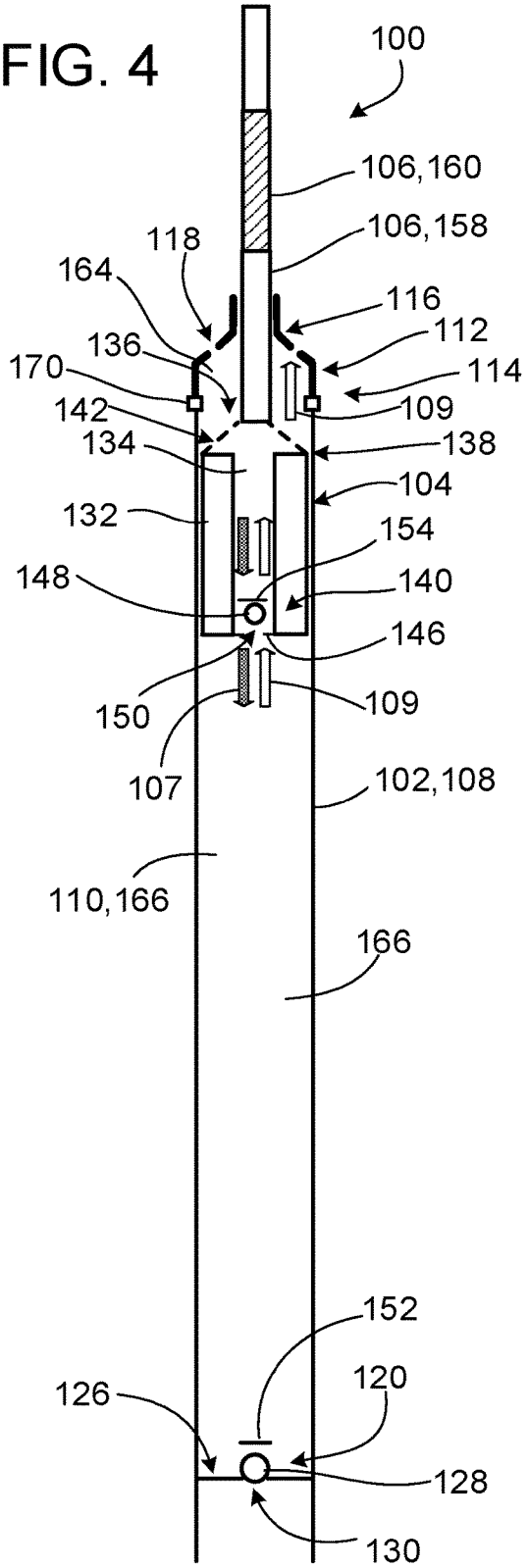
FIG. 4 is a side cross-sectional view of the downhole pump of FIG. 1 at the end of an upstroke.

The rod 106 is attached to a deployment arm 156 and supports the plunger 104. The rod 106 includes a lower conducting shaft 158 that is attached to the connector 136 of the plunger 104 and an upper insulating shaft 160 that magnetically isolates the conducting shaft 158 from the magnetic guide 112 until the rod 106 is pulled upward to an axial position that locates the conducting shaft 158 within or sufficiently close to the magnetic guide 112, as shown in FIG. 4. At this position, the conducting shaft 158 and the stopper 154 of the traveling valve 140 extend the magnetic field generated by the magnetic guide 112, and the extended magnetic field acts on the magnetic ball 148 to pull (for example, reject) the magnetic ball 148 upward from the opening 150 of the platform 146. The conducting shaft 158 is typically made of a ferromagnetic material, while the isolating shaft 160 is typically made of or coated with a ceramic material.

As mentioned above, the downhole pump 100 is designed to artificially lift well fluid 101 in a manner that avoids development of a gas locking condition within the downhole pump 100. Referring to FIG. 1, at an initial step of a fluid lifting operation, the downhole pump 100 is deployed to a target location near a bottom hole end of a tubing 103 before the tubing 103 contains any well fluid 101 and with the plunger 104 located at a reference position 162 within the housing 102. The housing 102 of the downhole pump 100 is maintained at the desired vertical location within the tubing 103 at a seating nipple 111 on the tubing 103. The seating nipple 111 provides fluid isolation and a holding mechanism that prevents the downhole pump 100 from unseating during operation.

Once the well begins to produce well fluid 101 such that the well fluid 101 collects within the tubing 103, the well fluid 101 exerts enough pressure on the standing valve 120 and subsequently, on the traveling valve 140, to flow into the housing 102 and then into the plunger 104 of the downhole pump 102. The well fluid 101 continues to accumulate within the housing 102 to fill the entire fluid reservoir 110, thereby forming a column 164 of well fluid 101 above the plunger 104. At this stage, with the fluid reservoir 110 of the housing 102, with the fluid receptacle 134 the plunger 104 filled with well fluid 101, and with the plunger 104 located at the reference position 162, the standing valve 120 is closed, and the traveling valve 140 is open.

Figure 2:
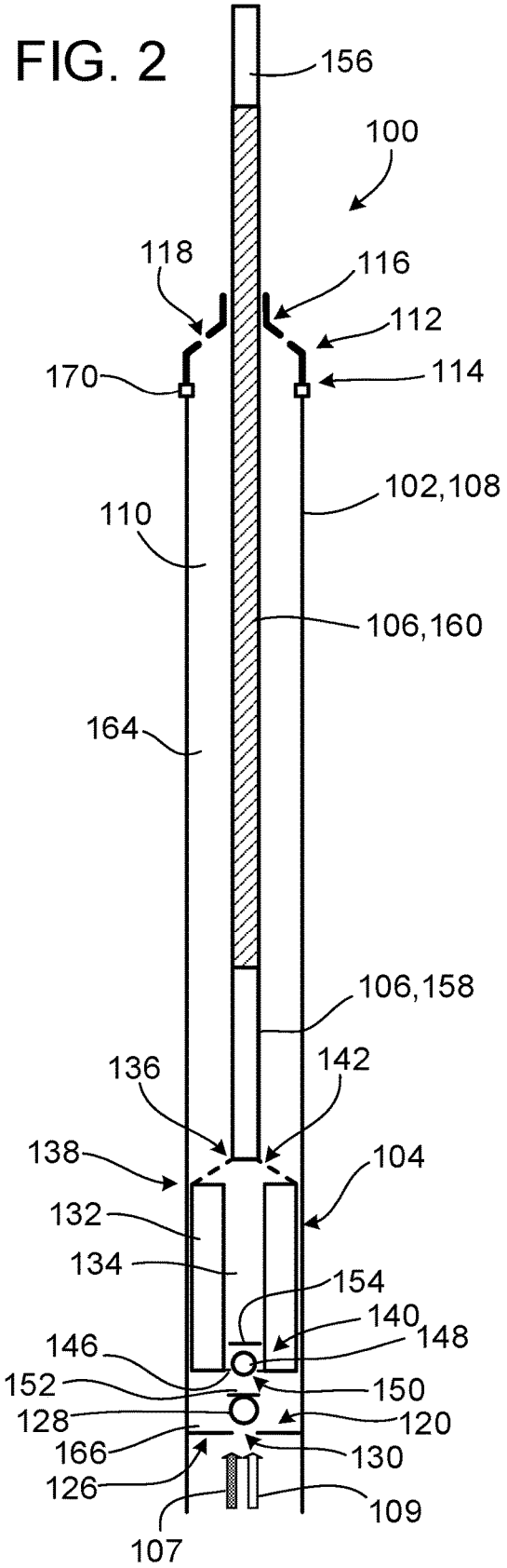
FIG. 2 is a side cross-sectional view of the downhole pump of FIG. 1 at the beginning of an upstroke.

Referring to FIG. 2, a surface crank (not shown) that is attached to the deployment arm 156 is then operated to lift the plunger 104 towards the surface in an upward movement (for example, an upstroke). Lifting of the plunger 104 transports the column 164 of well fluid 101 located above the plunger 104 to the surface, where the well fluid 101 is pushed through the openings 118 in the magnetic guide 112 to exit the downhole pump 100. Lifting of the plunger 104 progressively lowers the fluid pressure within a region 166 of the fluid reservoir 110 between the plunger 104 and the standing valve 120 (for example, due to a suction force generated by the upward moving plunger 104). Once the fluid pressure within the region 166 falls below the fluid pressure below the standing valve 120, the standing valve 120 opens to allow well fluid 101 below the standing valve 120 to enter the housing 102. For example, the well fluid 101 below the standing valve 120 pushes the ball 128 upward and out of the opening 130 of the platform 126 to flow into the housing 102. The ball 128 moves vertically until it abuts the stopper 152 and is maintained in position adjacent the stopper 152 by the upward flow of well fluid 101 as the plunger 104 continues to be lifted through the housing 102.

Figure 3:
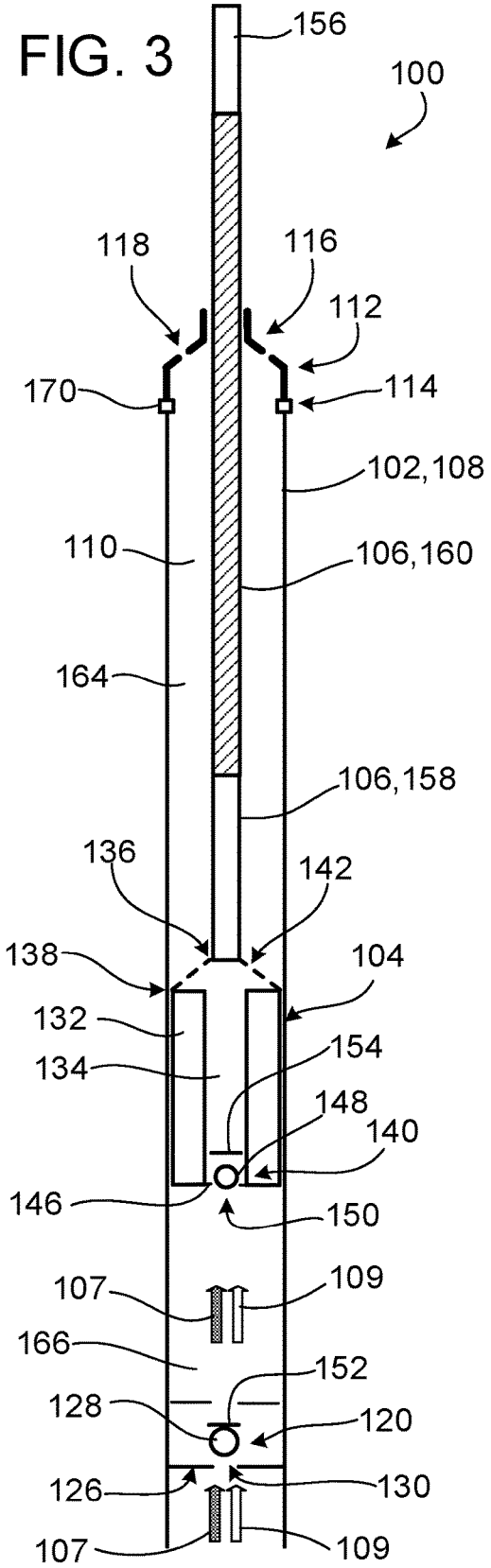
FIG. 3 is a side cross-sectional view of the downhole pump of FIG. 1 during an upstroke.

Referring to FIG. 3, as the plunger 104 continues to be lifted during the upstroke and the well fluid 101 continues to flow into the housing 102, the fluid pressure within the region 166 is lower than a fluid pressure within the fluid receptacle 134 of the plunger 134 such that the traveling valve 140 remains closed. Referring to FIG. 4, once the conducting shaft 158 of the rod 106 reaches the axial position of the magnetic guide 112, the magnetic field generated by the magnetic guide 112 is extended by the conducting shaft 158 and the stopper 154 to reach the magnetic ball 148. Under the attractive force of the extended magnetic field, the magnetic ball 148 is pulled upward from the opening 150 of the platform 146 to open the traveling valve 140. The magnetic ball 148 abuts the stopper 154 and is maintained in position to maintain the traveling valve 140 in an open state as long as the conducting shaft 158 is sufficiently close to the magnetic guide 112.

With the traveling valve 140 open at the end of the upstroke, the incompressible liquid 107 (for example, a mixture of oil and water) within fluid receptacle 134 flows downward out of the plunger 104 and into the region 166 of the fluid reservoir 110, while the compressible gas 109 within the region 166 of the fluid reservoir 110 flows upward and into the plunger 104. The gas 109 continues to flow upward through the openings 142 of the plunger 104 and subsequently through the openings 118 of the magnetic guide 112 to exit the downhole pump 102 at the surface. Accordingly, gas 109 that would have otherwise been trapped within the region 166 of the fluid reservoir 110 is permitted to escape the housing 102 of the downhole pump 100 at the surface. Referring still to FIG. 4, while the gas 109 is vented from the downhole pump 100 at the end of the upstroke, flow of liquid 107 from the plunger 104 into the region 166 of the fluid reservoir 110 increases the fluid pressure within the fluid reservoir 110 to a level that exceeds the fluid pressure of the well fluid 101 below the standing valve 120 to force the standing valve 120 closed again.

Figure 5:
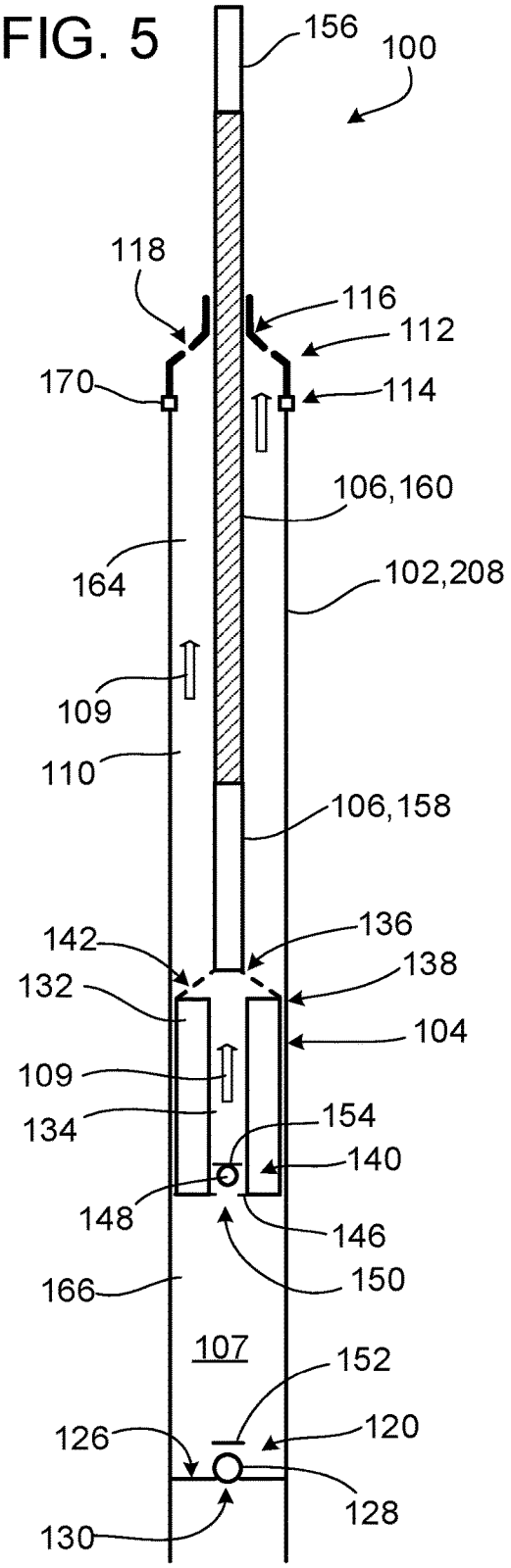
FIG. 5 is a side cross-sectional view of the downhole pump of FIG. 1 during a downstroke.

At the end of the upstroke, with the traveling valve 140 remaining open and with the standing valve 120 remaining closed, the plunger 104 is moved downward through the housing 102 in a downward movement (for example, a downstroke). Referring to FIG. 5, during the downstroke, gas 109 within the region 166 continues to flow upward into the plunger 104, out of the plunger 104 through the openings 142 in the connector 136, further upward into the column 164, and out of the housing 102 through the openings 118 in the magnetic guide 112. During the downstroke, the plunger 104 also displaces liquid 107 within the region 166 of the fluid reservoir 110 to the column 164 of well fluid 101 above the plunger 104 for later transport of the column 164 to the surface during a subsequent upstroke. The standing valve 120 remains closed during the downstroke because the fluid pressure of the well fluid 101 within the fluid reservoir 110 of the housing 102 remains higher than the fluid pressure of the well fluid 101 below the standing valve 120.

By the end of the downstroke, the fluid pressure of the well fluid 101 above the traveling valve 140 (for example, within the column 164 above the plunger 104 and within the fluid receptacle 134 of the plunger 104) has exceeded the fluid pressure of the well fluid 101 below the traveling valve 140 (for example, in the region 166 of the fluid reservoir 110) to force the traveling valve 140 closed again, as shown in FIG. 1. With the fluid reservoir 110 filled with the column 164 of well fluid 101 above the plunger 104, the plunger 104 can be lifted in a next upstroke to transport the column 164 of well fluid 101 to the surface, as already discussed with respect to FIGS. 2 and 3. The downhole pump 100 can be continually and cyclically operated in as described with respect to FIGS. 2-5 to lift well fluid 101 out of the tubing 103 (for example, and therefore out of the surrounding well) in an efficient manner (for example, to harvest well fluid 101 containing a relatively high fraction of liquid 107 and a relatively low fraction of gas 109 since much gas 109 has already escaped the housing 102 of the downhole pump 102 during a previous downstroke).

Opening of the traveling valve 120 (for example, as a result of the magnetic field generated by the magnetic guide 112) to allow escape of free compressible gas 109 at the end of an upstroke and during an immediately following downstroke prevents a gas-lock condition in which compressible gas 109 trapped beneath the plunger 104 would otherwise be compressed by the plunger 104 (for example, with the traveling valve 120 closed) during the downstroke. With the gas 109 trapped beneath the plunger 104 and compressed at a relatively high fluid pressure at the end of the downstroke, a subsequent upstroke would merely cause the trapped gas 109 to expand upward within the region 166 without reducing the fluid pressure within the region 166 enough to allow the standing valve 120 to open to permit inflow of additional well fluid 101 into the housing 102 of the downhole pump 100 for ongoing lifting of the well fluid 101 out of the well 103.

Under these conditions, the downhole pump 100 (for example, the standing valve 120 of the downhole pump 100) is in a "locked" state that prevents fluid intake. Forced opening of the traveling valve 140 at the end of the upstroke thus prevents a gas locking condition and accordingly provides the downhole pump 100 with an extended operating window for operation at wells with relatively high gas to liquid ratios using a simple magnetic mechanism that is more cost-effective than alternative complicated mechanisms of conventional downhole gas handling pumps. This functionality thus provides relatively high production capacity of the downhole pump 100, relatively high volumetric efficiency of the downhole pump 100, maximization of overall system efficiency, and avoidance of broader system-level problems associated with unwanted gas production. In some examples, a conventional sucker rod pump or other pump may be modified or retrofitted with the necessary components at a relatively low cost to be converted into a form of the downhole pump 100.

Figure 6:
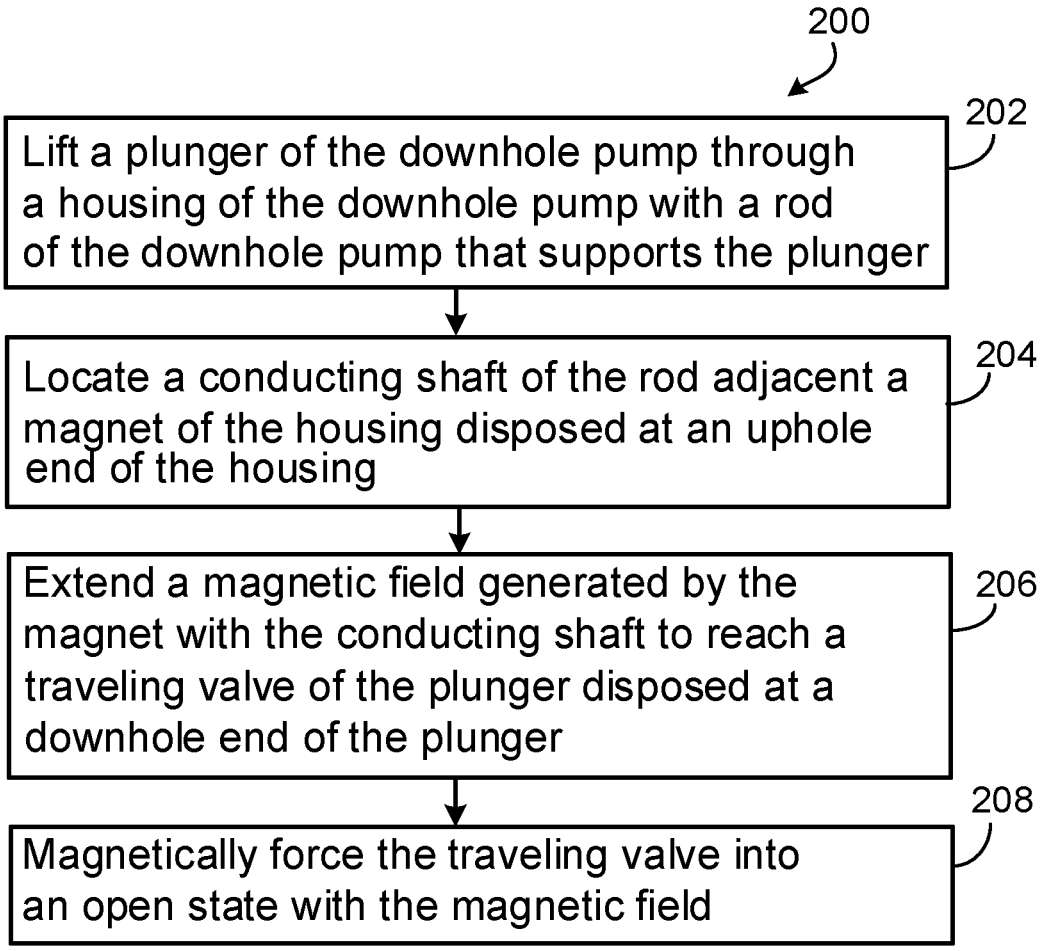
FIG. 6 is a flow chart illustrating an example method of operating the downhole pump of FIG. 1.

FIG. 6 is a flow chart illustrating an example method 200 of operating a downhole pump (for example, the downhole pump 100). In some embodiments, the method 200 includes a step 202 for lifting a plunger (for example, the plunger 104) of the downhole pump through a housing (for example, the housing 102) of the downhole pump with a rod (for example, the rod 106) of the downhole pump that supports the plunger. In some embodiments, the method 200 further includes a step 204 for locating a conducting shaft (for example, the conducting shaft 158) of the rod adjacent a magnet (for example, the magnetic guide 112) of the housing disposed at an uphole end (for example, the uphole end 114) of the housing. In some embodiments, the method 200 further includes a step 206 for extending a magnetic field generated by the magnet with the conducting shaft to reach a traveling valve (for example, the traveling valve 140) of the plunger disposed at a downhole end (for example, the downhole end 144 of the plunger. In some embodiments, the method 200 further includes a step 208 for magnetically forcing the traveling valve into an open state with the magnetic field.

While the downhole pump 100 has been described and illustrated with respect to certain dimensions, sizes, shapes, arrangements, materials, and methods 200, in some embodiments, a downhole pump 100 that is otherwise substantially similar in construction and function to the downhole pump 100 may include one or more different dimensions, sizes, shapes, arrangements, configurations, and materials or may be utilized according to different methods. Accordingly, other embodiments are also within the scope of the following claims.

What is claimed is:

1. A downhole pump comprising:

a housing comprising a magnet disposed at an uphole end of the housing;

a plunger disposed within the housing and comprising a traveling valve disposed at a downhole end of the plunger; and a rod comprising a conducting shaft attached to an uphole end of the plunger and configured to extend a magnetic field generated by the magnet when the conducting shaft is positioned adjacent the magnet to magnetically force the traveling valve into an open state.

2. The downhole pump of claim 1, wherein the housing comprises a standing valve disposed at a downhole end of the housing.

3. The downhole pump of claim 2, wherein the standing valve comprises:

a platform that defines an opening, and a ball that is sized to seat within the opening to close the standing valve to prevent fluid flow into the housing.

4. The downhole pump of claim 1, wherein the magnet is perforated to allow fluid flow therethrough.

5. The downhole pump of claim 1, wherein the rod passes through the magnet.

6. The downhole pump of claim 1, wherein the rod further comprises an isolating shaft that magnetically isolates the conducting shaft from the magnet while the conducting shaft is spaced axially apart from the magnet.

7. The downhole pump of claim 1, wherein the plunger comprises a connector that couples the plunger to the rod, and wherein the connector is perforated to allow fluid flow therethrough.

8. The downhole pump of claim 1, wherein the traveling valve comprises:

a platform that defines an opening, and a ball that is sized to seat within the opening to close the traveling valve to prevent fluid flow into the plunger.

9. The downhole pump of claim 8, wherein the ball is magnetic.

10. The downhole pump of claim 8, wherein the traveling valve further comprises a stopper that is spaced apart from the platform for limiting an axial movement of the ball.

11. A method of operating a downhole pump, the method comprising:

lifting a plunger of the downhole pump through a housing of the downhole pump with a rod of the downhole pump that supports the plunger;

locating a conducting shaft of the rod adjacent a magnet of the housing disposed at an uphole end of the housing;

extending a magnetic field generated by the magnet with the conducting shaft to reach a traveling valve of the plunger disposed at a downhole end of the plunger; and magnetically forcing the traveling valve into an open state with the magnetic field.

12. The method of claim 11, further comprising flowing gas from a fluid reservoir of the housing upward and into the plunger through the traveling valve in the open state.

13. The method of claim 12, further comprising:

flowing the gas upward and out of the plunger into the housing through openings in the plunger; and flowing the gas upward and out of the housing through openings in the magnet to release the gas from the downhole pump.

14. The method of claim 12, further comprising flowing liquid from a fluid receptacle of the plunger downward and into the fluid reservoir of the housing through the traveling valve in the open state.

15. The method of claim 12, further comprising moving the plunger downward through the housing with the traveling valve in the open state.

16. The method of claim 15, further comprising magnetically isolating the conducting shaft of the rod with an isolating shaft of the rod.

17. The method of claim 15, further comprising preventing fluid from flowing into the housing at a standing valve disposed at a downhole end of the housing.

18. The method of claim 11, further comprising:

lifting a column of fluid disposed above the plunger through the housing to the uphole end of the housing; and flowing the fluid out of the housing.

19. The method of claim 11, further comprising flowing fluid into the housing through a standing valve in an open state at a downhole end of the housing.

20. The method of claim 11, wherein the traveling valve comprises:

a platform that defines an opening, and a magnetic ball that is sized to seat within the opening to close the traveling valve to prevent fluid flow into the plunger.

* * * * *